US006307309B1

(12) United States Patent
Okamoto et al.

(10) Patent No.: US 6,307,309 B1
(45) Date of Patent: Oct. 23, 2001

(54) FIELD EMISSION COLD CATHODE DEVICE AND MANUFACTURING METHOD THEREOF

(75) Inventors: Akihiko Okamoto; Kazuo Konuma, both of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/375,397

(22) Filed: Aug. 17, 1999

(30) Foreign Application Priority Data

Aug. 18, 1998 (JP) ..... 10-231811

(51) Int. Cl.[7] ..... H01J 1/02; H01J 29/70

(52) U.S. Cl. ..... 313/309; 313/306; 313/336; 313/351; 313/495; 445/24

(58) Field of Search ..... 313/309, 336, 313/351, 306, 495; 445/50, 51, 46, 24; 315/169.1, 169.3

(56) References Cited

U.S. PATENT DOCUMENTS 5,191,217 * 3/1993 Kane et al. ..... 250/423
5,877,594 3/1999 Miyano et al. ..... 315/169.1
5,955,849 * 9/1999 Tang et al. ..... 315/382

FOREIGN PATENT DOCUMENTS 07-161283 6/1995 (JP) ..... H01J/1/30
9-306338 11/1997 (JP) .
10-050201 2/1998 (JP) ..... H01J/1/30
10-092295 4/1998 (JP) ..... H01J/1/30

* cited by examiner

*Primary Examiner*—Ashok Patel
*Assistant Examiner*—Sikha Roy
(74) *Attorney, Agent, or Firm*—Foley & Lardner

(57) ABSTRACT

The present invention relates to a method of manufacturing a field emission cold cathode device, having a field emission cold cathode element which comprises a plurality of emitters formed on a substrate and each in the shape of a sharply pointed cone, and a gate electrode provided with an opening section to let electrons emit from the respective apexes of said group of emitters and set in the vicinity above said group of emitters, wherein a positive voltage with respect to the emitters is applied to said gate electrode and thereby an electron beam is emitted from the group of emitters; a lens electrode making the electron beam which is emitted from said group of emitters converge; and a target on which the electron beam made to converge by said lens electrode irradiates; wherein the area of the region occupied by the group of emitters is set at the optimum size using specific equations. According to the present invention, it is possible to provide a field emission cold cathode device capable to accomplish excellent emission and convergence of the electron beam without making trial and error in experiments but with designing.

6 Claims, 7 Drawing Sheets

FIELD EMISSION COLD CATHODE DEVICE AND MANUFACTURING METHOD THEREOF

BACKGROUND OF THE INVENTION

1. Field of the Invention

The present invention relates to a field emission cold cathode device and more particularly to a device in which an electron beam sent forth from a field emission cold cathode element converges on a target.

2. Description of the Related Art

A field emission cold cathode element is an element comprising an emitter that is formed, on a substrate, in the shape of a pointed cone and a gate electrode that is provided with an opening of the order of submicron in the vicinity of this emitter, wherein a voltage applied, in a vacuum, between these two generates a high electric field centered on the apex of the emitter, and thereby electrons are emitted from the apex of the emitter.

Such a field emission cold cathode element is capable to produce a higher current density than a thermionic cathode element and therefore, taking advantage of this, the application thereof to devices in which an electron beam sent forth from this cold cathode element is required to converge on a target, for example, an electron-beam exposure system, a Braun tube, an electron-beam welding device, an electron-beam heating device and an electron-beam machining device is under consideration.

In such a device, electrons emitted from the emitter pass through an electron lens placed above the emitter with respect to the direction of the electron emission and converge on a target. FIG. 1 shows the basic structure thereof (Note that all the drawings shown herein below lie sideways). Electrons emitted from an emitter 1 travel in a vacuum in directions within a certain angle of divergence (an angle made between the travelling direction of the outermost electron when the kinetic energy of an electron is e·V and the line normal to the gate face is, hereinafter, referred to as the "electron beam divergence angle (p)"), pass through an electron lens system composed of lens electrodes 3 and 4, and reach a target (screen) 5, converging from directions within a certain angle (an angle made between the travelling direction of the outermost electron when received on the target and the line normal to the gate face is, hereinafter, referred to as the "electron beam incident angle (q)").

In devices such as the electron-beam exposure system, the Braun tube, the electron-beam welding device, the electron-beam heating device, the electron-beam machining device and the like, the current density on the target must be particularly high. For this reason, it is essential that the field emission cold cathode is capable to emit electrons of a high current density. Furthermore, the electron lens and the target therein should have good focus characteristics to achieve the high current density.

In a device of this sort, however, when a large current is taken out from the emitter, the electron beam tends to spread with increasing current, because of the interaction between electrons owing to the Coulomb repulsion, and, as a result, some electrons strike lens electrodes 3 and 4 shown in FIG. 1. In this condition, even if the degree of vacuum is heightened, adsorption gas dissociates from the lens electrode struck by electrons, and this gas turns into cations, which fly towards the emitter. Especially in the case that the potential difference between the lens electrode and the emitter is 100 V or more, the cations are accelerated enough to collide with the emitter. Meanwhile, in the field emission cold cathode element, the distance between the gate electrode and the emitter is equal to or less than several micron and besides the potential difference between these two is normally equal to or more than 50 V. Consequently, under the influence of the electric field thereof, cations colliding with the emitter ionize the residual gas further, amplify the ion current in a manner of avalanche, and give rise to the electric discharge. In this state, if no mechanism to limit the current exists on the side of the emitter, the current flows so much as to melt the emitter, resulting in the breakdown of the element. Even when provided with a resistance or a current limiter structure for the purpose of preventing the electric discharge, cations sputter the emitter material, in addition to giving a shock, which deteriorates the emitter and causes a reduction of the electron emission.

Therefore, it is a matter of great importance that the electron beam divergence angle is made small by keeping the Coulomb interaction between emitted electrons under control. Nevertheless, neither the behaviour of electrons in the field emission cold cathode element has been well understood nor the effect of the Coulomb interaction has been quantitatively measured in the experiments.

Moreover, there are demands that the electron beam is made to converge to a still smaller region on the target. Although it is empirically known that the area of this region depends on the size of the emitter and the gate voltage, the relationship between characteristics of the emitter and characteristics of the electron lens in use has not been much understood yet.

SUMMARY OF THE INVENTION

An object of the present invention is to provide a method of manufacturing a field emission cold cathode device in which an electron beam sent forth from a field emission cold cathode element converges on a target; which can produce an arrangement enabling to accomplish excellent emission and the convergence of the electron beam, without making troublesome trial and error that is conventionally done by carrying out experiments, but with designing the field emission cold cathode element, an electron lens and the target. Further, another object of the present invention is to provide a field emission cold cathode device capable to accomplish excellent emission and convergence of the electron beam.

The present invention relates to a field emission cold cathode device; having:

- a field emission cold cathode element which comprises a plurality of emitters formed on a substrate and each in the shape of a sharply pointed projection, and a gate electrode provided with an opening section to let electrons emit from the respective apexes of said group of emitters and set in the vicinity above said group of emitters, wherein a positive voltage with respect to the emitters is applied to said gate electrode and thereby an electron beam is emitted from the group of emitters;
- a lens electrode making the electron beam which is emitted from said group of emitters converge; and
- a target on which the electron beam made to converge by said lens electrode irradiates; wherein:
  - the area S of a region occupied by the group of emitters is equal to or more than $$9\cdot I\cdot L^2/\{4\cdot e_0(2\cdot e/m)^{1/2}\cdot(Vg^{1/2}+Vgl^{1/2})^3\},$$

where, with respect to the emitters, Vg is the gate voltage, Vgl is the voltage of the lens electrode placed directly above the emitters, I is the current in use, L is the distance between the gate electrode and the lens electrode, m is the mass of the electron, e is the electric charge and $e_0$ is the permittivity of a vacuum.

Further, the present invention relates to a field emission cold cathode device; having:

a field emission cold cathode element which comprises a plurality of emitters formed on a substrate and each in the shape of a sharply pointed projection, and a gate electrode provided with an opening section to let electrons emit from the respective apexes of said group of emitters and set in the vicinity above said group of emitters, wherein a positive voltage with respect to the emitters is applied to said gate electrode and thereby an electron beam is emitted from the group of emitters;

a lens electrode making the electron beam which is emitted from said group of emitters converge; and a target on which the electron beam made to converge by said lens electrode irradiates; wherein:

the area S of a region occupied by the group of emitters is equal to or less than $$St\cdot(Vt/Vg)\cdot\{\sin(q)/\sin(p)\}^2,$$

where, with respect to the emitters, Vg is the gate voltage, Vt is the target voltage, e is the electric charge, p is the angle made between the travelling direction of the outermost electron in the electron beam when the kinetic energy of an electron from the emitters is e·Vg and the line normal to the gate face, St is the area of the electron beam on the target, q is the angle made between the travelling direction of the outermost electron in the electron beam incident on the target and the line normal to the gate face and I is the current in use.

Further, the present invention relates to a field emission cold cathode device; having:

a field emission cold cathode element which comprises a plurality of emitters formed on a substrate and each in the shape of a sharply pointed projection, and a gate electrode provided with an opening section to let electrons emit from the respective apexes of said group of emitters and set in the vicinity above said group of emitters, wherein a positive voltage with respect to the emitters is applied to said gate electrode and thereby an electron beam is emitted from the group of emitters;

a lens electrode making the electron beam which is emitted from said group of emitters converge; and a target on which the electron beam made to converge by said lens electrode irradiates; wherein:

the area S of a region occupied by the group of emitters is equal to or more than $$9\cdot I\cdot L^2/\{4\cdot e_0(2\cdot e/m)^{1/2}\cdot(Vg^{1/2}+Vgl^{1/2})^3\},$$

where, with respect to the emitters, Vg is the gate voltage, Vgl is the voltage of the lens electrode placed directly above the emitters, I is the current in use, L is the distance between the gate electrode and the lens electrode, m is the mass of the electron, e is the electric charge and $e_0$ is the permittivity of a vacuum; and, at the same time, the area S of the region occupied by the group of emitters is equal to or less than $$St\cdot(Vt/Vg)\cdot\{\sin(q)/\sin(p)\}^2,$$

where, with respect to the emitters, Vg is the gate voltage, Vt is the target voltage, e is the electric charge, p is the angle made between the travelling direction of the outermost electron in the electron beam when the kinetic energy of an electron from the emitters is e·Vg and the line normal to the gate face, St is the area of the electron beam on the target, q is the angle made between the travelling direction of the outermost electron in the electron beam incident on the target and the line normal to the gate face and I is the current in use.

Further, the present invention relates to a method of manufacturing a field emission cold cathode device, having:

a field emission cold cathode element which comprises a plurality of emitters formed on a substrate and each in the shape of a sharply pointed projection, and a gate electrode provided with an opening section to let electrons emit from the respective apexes of said group of emitters and set in the vicinity above said group of emitters, wherein a positive voltage with respect to the emitters is applied to said gate electrode and thereby an electron beam is emitted from the group of emitters;

a lens electrode making the electron beam which is emitted from said group of emitters converge; and a target on which the electron beam made to converge by said lens electrode irradiates; which comprises steps of:

forming the element so as to make the area S of a region occupied by the group of emitters equal to or more than $$9\cdot I\cdot L^2/\{4\cdot e_0(2\cdot e/m)^{1/2}\cdot(Vg^{1/2}+Vgl^{1/2})^3\},$$

where, with respect to the emitters, Vg is the gate voltage, Vgl is the voltage of the lens electrode placed directly above the emitters, I is the current in use, L is the distance between the gate electrode and the lens electrode, m is the mass of the electron, e is the electric charge and $e_0$ is the permittivity of a vacuum.

Further, the present invention relates to a method of manufacturing a field emission cold cathode device, having:

a field emission cold cathode element which comprises a plurality of emitters formed on a substrate and each in the shape of a sharply pointed projection, and a gate electrode provided with an opening section to let electrons emit from the respective apexes of said group of emitters and set in the vicinity above said group of emitters, wherein a positive voltage with respect to the emitters is applied to said gate electrode and thereby an electron beam is emitted from the group of emitters;

a lens electrode making the electron beam which is emitted from said group of emitters converge; and a target on which the electron beam made to converge by said lens electrode irradiates; which comprises steps of:

forming the element so as to make the area S of a region occupied by the group of emitters equal to or less than $$St\cdot(Vt/Vg)\cdot\{\sin(q)/\sin(p)\}^2,$$

where, with respect to the emitters, Vg is the gate voltage, Vt is the target voltage, e is the electric charge, p is the angle made between the travelling direction of the outermost electron in the electron beam when the kinetic energy of an electron from the emitters is e·Vg and the line normal to the gate face, St is the area of the electron beam on the target, q is the angle made between the travelling direction of the outermost electron in the electron beam incident on the target and the line normal to the gate face and I is the current in use.

Further, the present invention relates to a method of manufacturing a field emission cold cathode device, having:

a field emission cold cathode element which comprises a plurality of emitters formed on a substrate and each in the shape of a sharply pointed projection, and a gate electrode provided with an opening section to let electrons emit from the respective apexes of said group of emitters and set in the vicinity above said group of emitters, wherein a positive voltage with respect to the emitters is applied to said gate electrode and thereby an electron beam is emitted from the group of emitters;

a lens electrode making the electron beam which is emitted from said group of emitters converge; and a target on which the electron beam made to converge by said lens electrode irradiates; which comprises steps of:

forming the element so as to make the area S of a region occupied by the group of emitters equal to or more than $$9\cdot I\cdot L^2/\{4\cdot e_0(2\cdot e/m)^{1/2}\cdot(Vg^{1/2}+Vgl^{1/2})^3\},$$

where, with respect to the emitters, Vg is the gate voltage, Vgl is the voltage of the lens electrode placed directly above the emitters, I is the current in use, L is the distance between the gate electrode and the lens electrode, m is the mass of the electron, e is the electric charge and $e_0$ is the permittivity of a vacuum; and, at the same time, make the area S of the region occupied by the group of emitters equal to or less than $$St\cdot(Vt/Vg)\cdot\{\sin(q)/\sin(p)\}^2,$$

where, with respect to the emitters, Vg is the gate voltage, Vt is the target voltage, e is the electric charge, p is the angle made between the travelling direction of the outermost electron in the electron beam when the kinetic energy of an electron from the emitters is e·Vg and the line normal to the gate face, St is the area of the electron beam on the target, q is the angle made between the travelling direction of the outermost electron in the electron beam incident on the target and the line normal to the gate face and I is the current in use.

Further, in the present invention described above, the term "region occupied by a group of emitters" denotes a region formed by joining tangent lines of the outermost circumference of the gate opening section which surrounds respective emitters.

The present invention enables to relate easily between characteristics of the element, the electrode added for the beam control, such as the lens electrode, the position of the target and so forth. Consequently, it becomes possible to provide a field emission cold cathode device capable to accomplish excellent emission and convergence of the electron beam without making conventional operations of trial and error but only with designing the device.

Especially in the case of the device which requires the emission of the high current density, it becomes possible to suppress the electric discharge which ordinarily takes place due to the unnecessary current running into the lens electrode and may cause the breakdown of the element, by setting the emitter conditions so as not to allow the electron beam to spread. Furthermore, since the maximum size for the region occupied by the group of emitters to obtain the image of the electron beam in the desired size on the target can be defined, the design thereof can be carried out with better efficiency and besides the unnecessary electric discharge can be prevented from occurring.

DETAILED DESCRIPTION OF THE INVENTION

The operation of the present invention is first described to assist better understanding of the present invention.

When a positive voltage is applied to a gate electrode with respect to the emitter in a device according to the present invention, the emission current is obtained, following the Fowler-Nordheim characteristic, at the time of the gate voltage application. If the amount of the current is large, however, the repulsion by electrons already emitted reduces the speed of the subsequent electrons.

Figure 1:
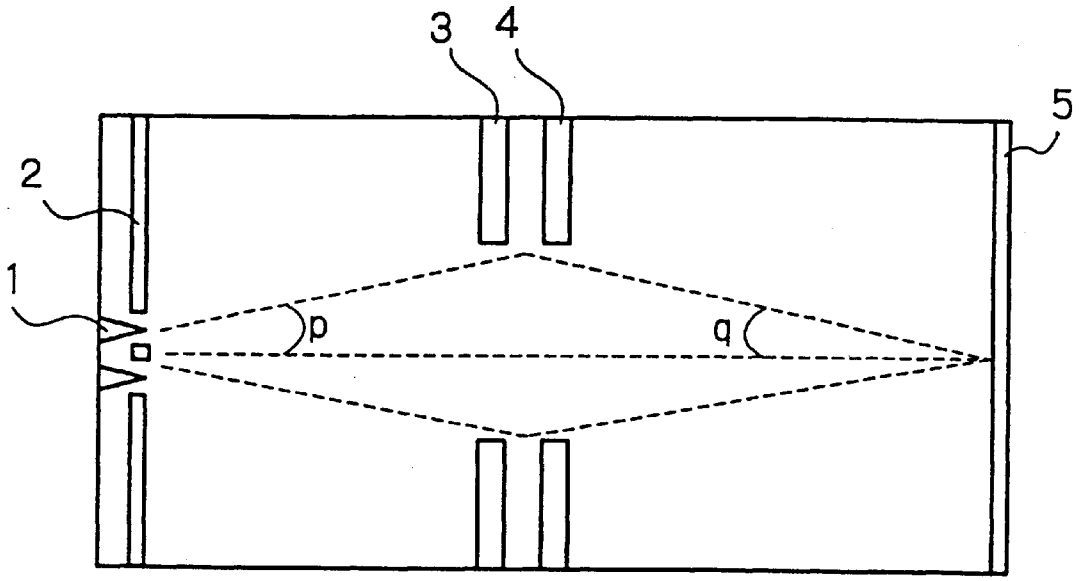
FIG. 1 is a schematic diagram showing a field emission cold cathode device in accordance with the present invention.
Figure 2:
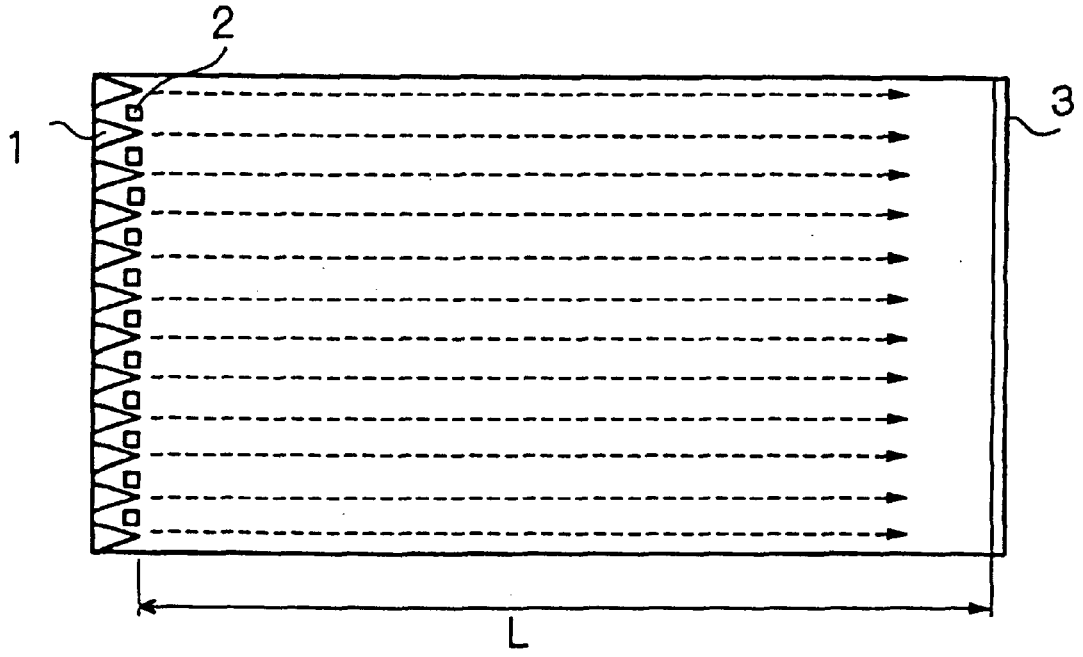
FIG. 2 is a schematic diagram of assistance illustrating a one-dimensional model in explaining the operation of the present invention.

Consider one-dimensional electron flows along the z-axis which is taken in the direction normal to the gate face, as shown in FIG. 2. If the emitter voltage is taken to be 0 V and the permittivity of a vacuum is denoted by $e_0$, the relation between the voltage V and the electron density r can be written, from the Maxwell equations, as $$d^2V/dz^2=-r/e_0.$$

Here the relation between the current density J and the electron density r is given by $$J=-r\cdot v,$$

where v is the velocity of the electron.

Now, let m denote the mass of the electron. The velocity v is then expressed in the form of $$v=(2\cdot e\cdot V/m)^{1/2}.$$

Thus, Equation (1) is obtained;

$$d^2V/dz^2=a/V^{1/2}, \quad (1)$$

where $$a=(J/e_0)\cdot(m/2e)^{1/2}.$$

When a voltage Vgl is applied to an electrode 3 that is placed at a distance of L from a gate electrode 2, as shown in FIG. 2, an electron is raised to a potential of Vg when in the vicinity of the gate and a potential of Vgl when around the electrode 3. Solution of the differential equation, Equation (1), under such boundary conditions yields an expression for the absolute quantity of the current density J, given by Equation (2);

$$J=4/(9\cdot L^2)\cdot e_0\cdot(2\cdot e/m)^{1/2}\cdot(Vg^{1/2}+Vgl^{1/2})^3. \quad (2)$$

The current density in one-dimensional analysis cannot be made larger than this. In real space, however, the current density sent forth from the emitter can be more than the above amount, in that case, electrons are deflected further sideways from the direction of the emission due to its own space-charge and, consequently, spread more. The interaction between electrons is especially strong directly above the emitter.

Therefore, for the region occupied by a group of emitters, the current density above region should be set smaller than J described by Equation (2), and this requirement determines, depending on a desired amount of the current, the area S of the region occupied by the group of emitters.

Meanwhile in devices such as the electron-beam exposure system, the Braun tube, the electron-beam welding device, the electron-beam heating device, the electron-beam machining device and the like, it is required to make the beam size on the target smaller so that the area of the region occupied by the group of emitters must be made as small as possible.

Figure 3:
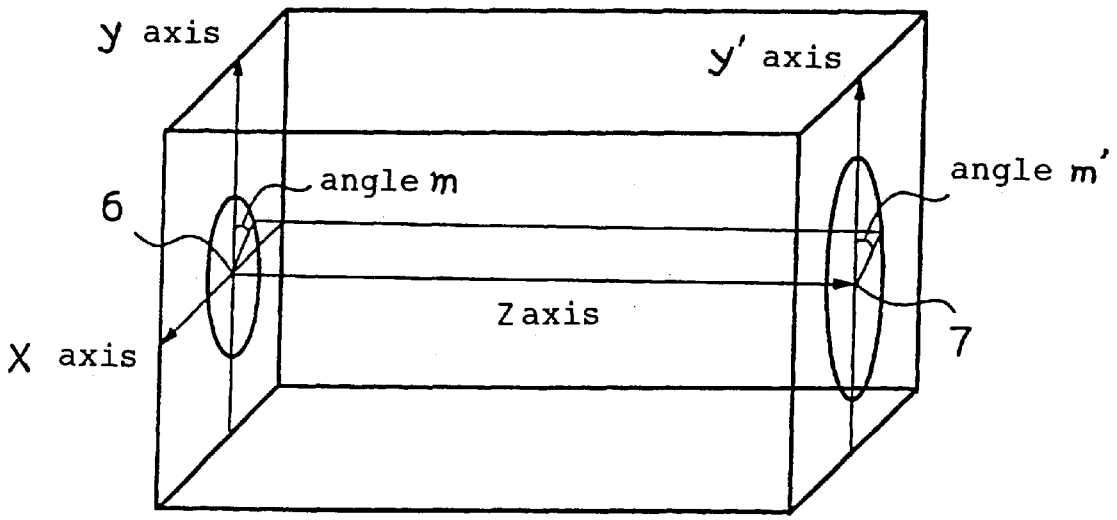
FIG. 3 is a schematic diagram of assistance showing the relationship between the starting point and the end point of an electron in explaining the operation of the present invention.

Let the axes set as shown in FIG. 3: the line joining the barycenter 6 of the region occupied by the group of emitters and the barycenter 7 of its image on the target is taken as the z-axis; an axis perpendicular to the z-axis and parallel to the ground is the x-axis; an axis passing through the barycenter 6 of the region occupied by the group of emitters and perpendicular to the ground is the y-axis; and an axis passing through the barycenter 7 of the image on the target and perpendicular to the ground is the y'-axis. Further, an angle that is made between the line joining the barycenter 6 of the region occupied by the group of emitters and a point on the periphery of the region and the y-axis is denoted by m; the distance between the barycenter 6 and the point on the periphery, by d(m); an angle that is made between the line joining a point on the target to which the point on the periphery converge through a lens and the barycenter 7 of the image on the target and the y'-axis, by m'; and the distance between the barycenter 7 on the target and the point on the periphery of the image on the target, by d'(m'). Now, Abbe's sine condition leads to the following equation;

$$d(m)Vg^{1/2}\cdot\sin(p)=d'(m')\,Vt^{1/2}\cdot\sin(q).$$

Thus, the area of the region occupied by the group of emitters must be equal to or less than the area obtained by integrating d(m) around one cycle of m, that is from 0 to 2·PI radian, which is, $$S=St\cdot(Vt/Vg)\cdot\{\sin(q)/\sin(p)\}^2.$$

Next, referring to the drawings, the embodiments of the present invention are described.

First Embodiment

Figure 4:
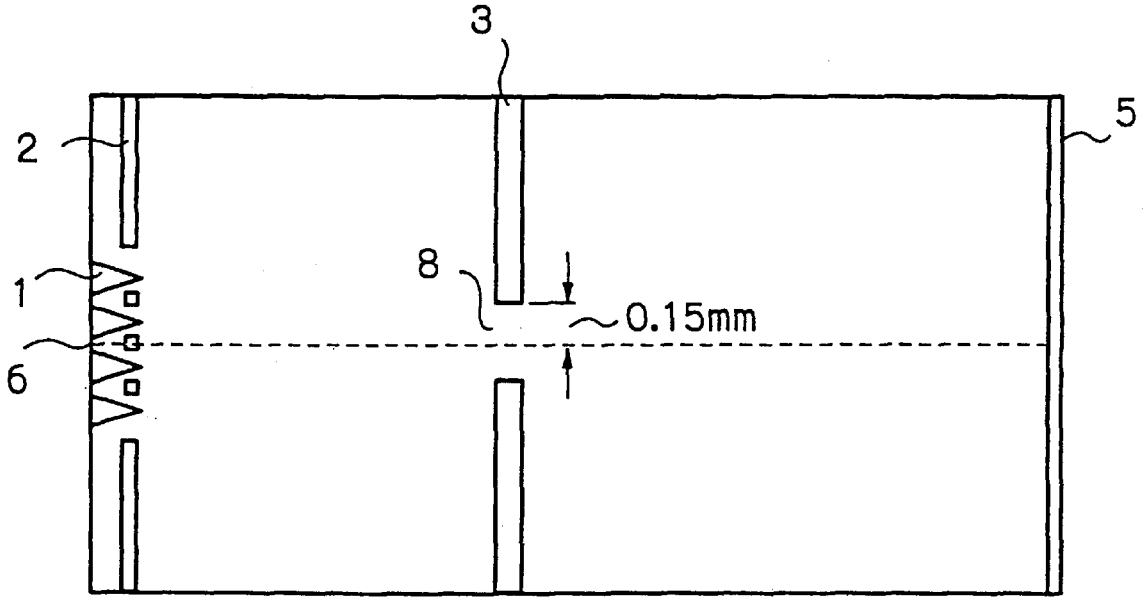
FIG. 4 is a schematic diagram showing the device structure according to the first embodiment of the present invention.

FIG. 4 is a schematic diagram showing the device structure according to the first embodiment of the present invention. The device of the present embodiment comprises a field emission cold cathode element having a circular emission region (a region occupied by a group of emitters) with a radius of 25 micron, a lens electrode 3 disposed at a distance of 0.7 mm above the emitters (cold cathode) 1, and an anode electrode (target) 5 placed 1 mm further away. In the lens electrode 3, there is provided with a circular opening 8 with a radius of 0.15 mm, the center thereof being the point where the perpendicular from the barycenter 6 of the region occupied by the group of emitters intersects the plane of the electrode for convergence 3.

Figure 5:
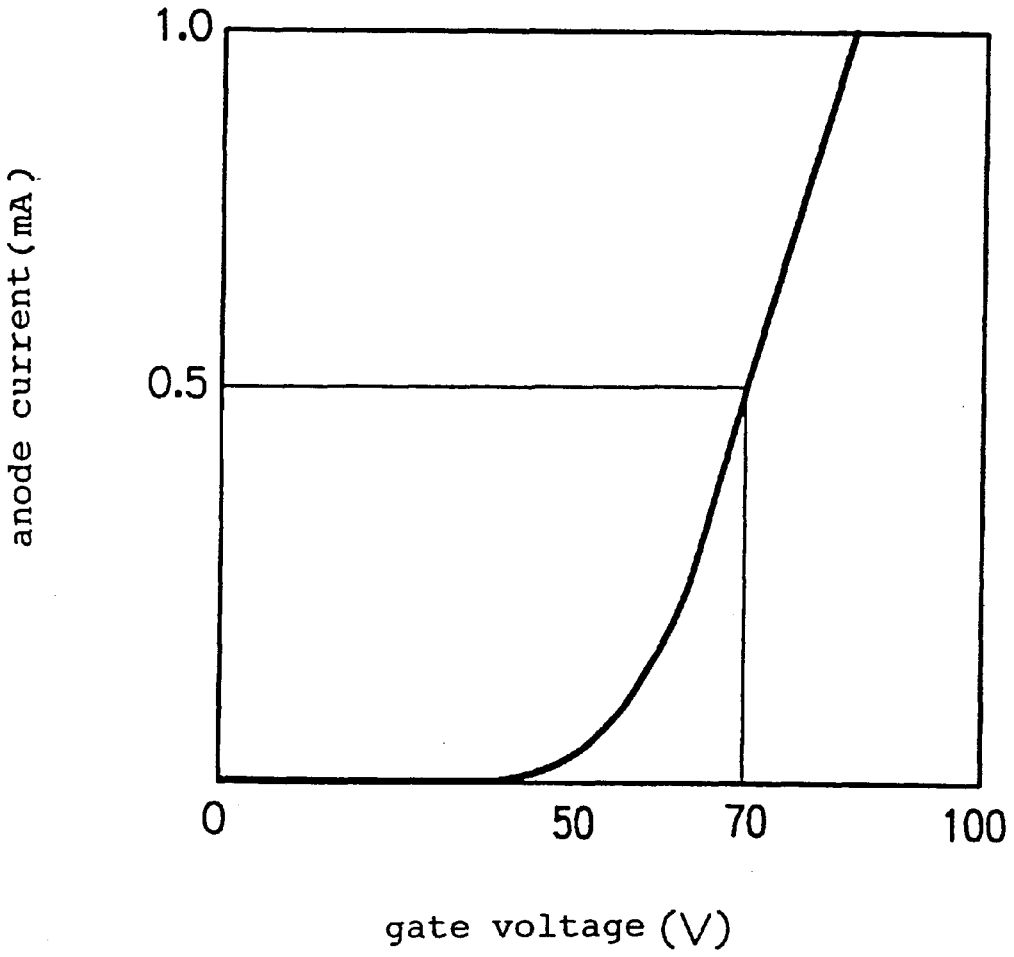
FIG. 5 is a diagram showing the current-voltage characteristic of a device according to the first embodiment of the present invention.
Figure 6:
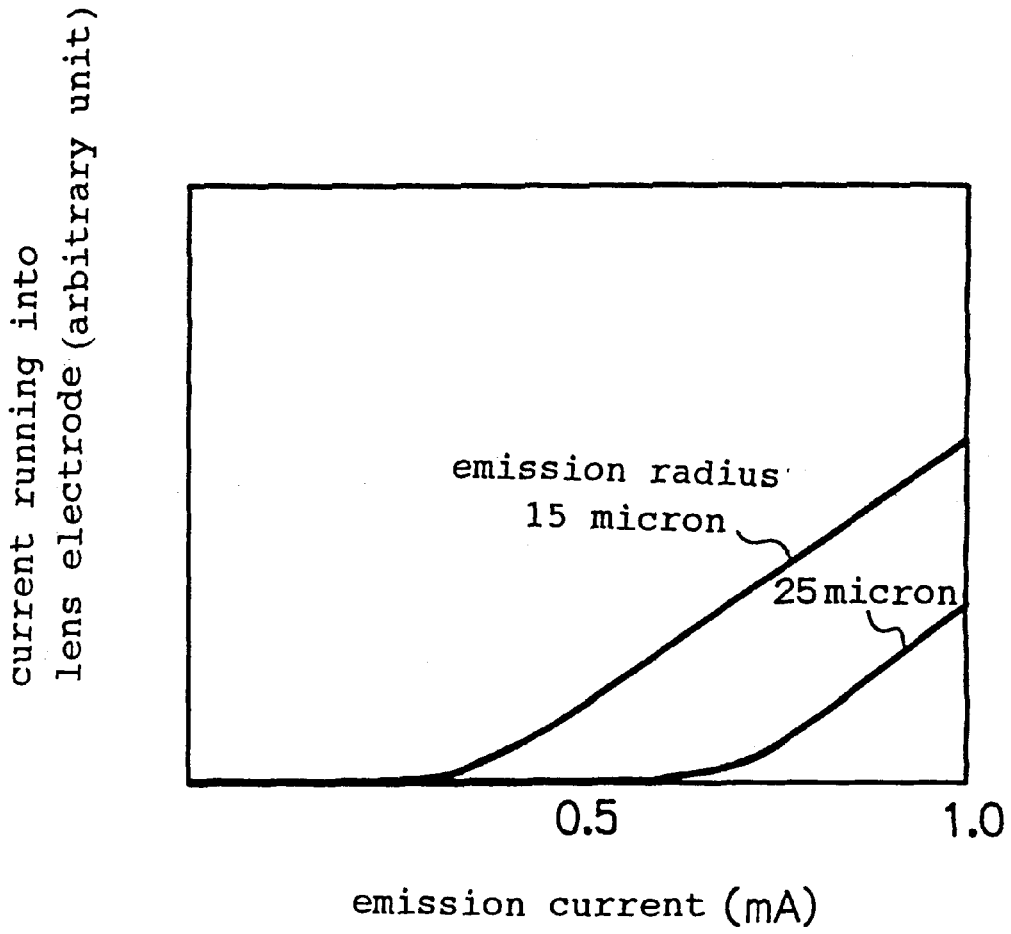
FIG. 6 is a diagram showing the emission current dependences of the current running into an electrode for convergence in a device according to the first embodiment of the present invention.

A gate electrode 2 was raised gradually from 0 V to a potential of 70 V, while 1000 V was each applied to the lens electrode 3 and the anode electrode 5. FIG. 5 shows the current-voltage characteristic of the device. When the gate voltage reached approximately 40 V, the emission current started to flow solely to the anode electrode, and as the gate voltage was raised further, the current increased, following the Fowler-Nordheim characteristic. With the gate voltage of about 70 V, the anode current became 0.5 mA. When the current increased still further, the electron beam started to spread owing to the space charge effect and some emission electrons began to enter into the lens electrode 3. The emission current dependence of the current running into the lens electrode 3 is shown in FIG. 6.

Next, a device having an emission region with an emission radius (a radius of a circular region occupied by a group of emitters) of 15 micron was formed and similar experiments were performed therewith. By increasing the gate voltage by 5 V or so from that in the case that the emission region has an emitter radius of 25 micron, equivalent electron emission thereto was obtained, but some emission electrons began to enter into the electrode for convergence 3 at the emission current of 0.3 mA. This can be attributed to the space-charge effect that started to show effects from a lower current because the emission region was small.

Further, in the case that the opening 8 in the lens electrode 3 was replaced with another circular one with a radius of 0.10 mm, it was found that the emission electron began to enter into the lens electrode 3 at an even lower current.

Further, the electron beam divergence angle p in the vicinity of emitters was calculated on the assumption that the transverse component of the electron velocity was constant. The result indicated that electrons in the vicinity of the emitters spread, up to the about 30° direction with respect to the perpendicular to the gate face.

Second Embodiment

Figure 7:
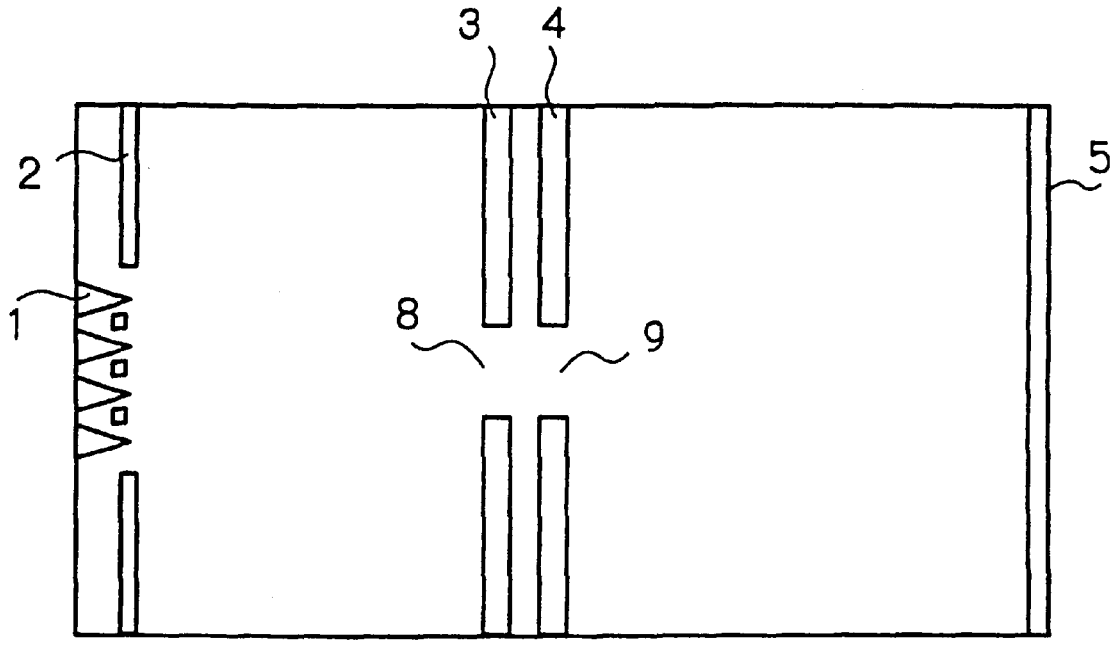
FIG. 7 is a schematic diagram showing the device structure according to the second embodiment of the present invention.

FIG. 7 is a schematic diagram showing the device structure according to the second embodiment of the present invention. The device of the present embodiment has an emitter 1. A lens electrode 3 therein is placed 1 mm away from the emitter 1 and a voltage of 1 kV is applied to this electrode 3. Adjacent to this, another lens electrode 4 is also disposed and 5 kV is applied to this electrode 4. In the centers of these lens electrodes 3 and 4, there are provided with respective circular openings 8 and 9 with a radius of 3 mm, and passing through these lenses, the electron beam travels to a target 5. This target 5 is set at a position approximately 10 mm distant from the lens electrode 4, and 5 kV is applied thereto.

If a 1 $mm^2$ electron irradiation region is required on the target, an emission region with an emission radius of 25 micron can attain that, being demonstrated that it really provides an electron irradiation region with an area of nearly 1 $mm^2$.

Next, it was examined at what position electrons pass through in the electron lens system composed of lens electrodes 3 and 4. In addition to that, under the condition that the voltages of the lens electrode 4 and the target 5 are set at 1 kV, the same as the lens electrode 3, the measurements were made to find out what extent the transmitted electrons spread over in the target section and how big the electron beam incident angle q was thereat. The results showed that the transmitting position of the beam in the electron lens was, at the outermost, 1 mm or so distant from the center thereof. Together with the finding in said first embodiment that the electron beam divergence angle p for electrons in the vicinity of emitters is approximately 30°, it was proved that the results of these experiments substantially satisfied the conditional equation of the present invention, that is, $$S=St\cdot(Vt/Vg)\cdot\{\sin(q)/\sin(p)\}^2.$$

Further, while the above embodiments are described using the specific size and lens system, it is to be understood that the present invention is not limited to these embodiments, and any size, a plurality of lenses or a plurality of electrodes may be used therein without departing from the spirit and scope of the invention.

What is claimed is:

1. A field emission cold cathode device; having:

a field emission cold cathode element which comprises a plurality of emitters formed on a substrate and each in the shape of a sharply pointed projection, and a gate electrode provided with an opening section to let electrons emit from the respective apexes of said group of emitters and set in the vicinity above said group of emitters, wherein a positive voltage with respect to the emitters is applied to said gate electrode and thereby an electron beam is emitted from the group of emitters;

a lens electrode making the electron beam which is emitted from said group of emitters converge; and a target on which the electron beam made to converge by said lens electrode irradiates; wherein:

the area S of a region occupied by the group of emitters is equal to or more than $$9\cdot I\cdot L^2/\{4\cdot e_0(2\cdot e/m)^{1/2}\cdot(Vg^{1/2}+Vgl^{1/2})^3\},$$

where, with respect to the emitters, Vg is the gate voltage, Vgl is the voltage of the lens electrode placed directly above the emitters, I is the current in use, L is the distance between the gate electrode and the lens electrode, m is the mass of the electron, e is the electric charge and $e_0$ is the permittivity of a vacuum.

2. A field emission cold cathode device; having:

a field emission cold cathode element which comprises a plurality of emitters formed on a substrate and each in the shape of a sharply pointed projection, and a gate electrode provided with an opening section to let electrons emit from the respective apexes of said group of emitters and set in the vicinity above said group of emitters, wherein a positive voltage with respect to the emitters is applied to said gate electrode and thereby an electron beam is emitted from the group of emitters;

a lens electrode making the electron beam which is emitted from said group of emitters converge; and a target on which the electron beam made to converge by said lens electrode irradiates; wherein:

the area S of a region occupied by the group of emitters is equal to or less than $$St\cdot(Vt/Vg)\cdot\{\sin(q)/\sin(p)\}^2,$$

where, with respect to the emitters, Vg is the gate voltage, Vt is the target voltage, e is the electric charge, p is the angle made between the travelling direction of the outermost electron in the electron beam when the kinetic energy of an electron from the emitters is e·Vg and the line normal to the gate face, St is the area of the electron beam on the target, q is the angle made between the travelling direction of the outermost electron in the electron beam incident on the target and the line normal to the gate face and I is the current in use.

3. A field emission cold cathode device; having:

a field emission cold cathode element which comprises a plurality of emitters formed on a substrate and each in the shape of a sharply pointed projection, and a gate electrode provided with an opening section to let electrons emit from the respective apexes of said group of emitters and set in the vicinity above said group of emitters, wherein a positive voltage with respect to the emitters is applied to said gate electrode and thereby an electron beam is emitted from the group of emitters;

a lens electrode making the electron beam which is emitted from said group of emitters converge; and a target on which the electron beam made to converge by said lens electrode irradiates; wherein:

the area S of a region occupied by the group of emitters is equal to or more than $$9\cdot I\cdot L^2/\{4\cdot e_0(2\cdot e/m)^{1/2}\cdot(Vg^{1/2}+Vgl^{1/2})^3\},$$

where, with respect to the emitters, Vg is the gate voltage, Vgl is the voltage of the lens electrode placed directly above the emitters, I is the current in use, L is the distance between the gate electrode and the lens electrode, m is the mass of the electron, e is the electric charge and $e_0$ is the permittivity of a vacuum; and, at the same time, the area S of the region occupied by the group of emitters is equal to or less than $$St\cdot(Vt/Vg)\cdot\{\sin(q)/\sin(p)\}^2,$$

where, with respect to the emitters, Vg is the gate voltage, Vt is the target voltage, e is the electric charge, p is the angle made between the travelling direction of the outermost electron in the electron beam when the kinetic energy of an electron from the emitters is e·Vg and the line normal to the gate face, St is the area of the electron beam on the target, q is the angle made between the travelling direction of the outermost electron in the electron beam incident on the target and the line normal to the gate face and I is the current in use.

4. A method of manufacturing a field emission cold cathode device, having:

a field emission cold cathode element which comprises a plurality of emitters formed on a substrate and each in the shape of a sharply pointed projection, and a gate electrode provided with an opening section to let electrons emit from the respective apexes of said group of emitters and set in the vicinity above said group of emitters, wherein a positive voltage with respect to the emitters is applied to said gate electrode and thereby an electron beam is emitted from the group of emitters;

a lens electrode making the electron beam which is emitted from said group of emitters converge; and a target on which the electron beam made to converge by said lens electrode irradiates; which comprises steps of:

forming the element so as to make the area S of a region occupied by the group of emitters equal to or more than $$9\cdot I\cdot L^2/\{4\cdot e_0(2\cdot e/m)^{1/2}\cdot(Vg^{1/2}+Vgl^{1/2})^3\},$$

where, with respect to the emitters, Vg is the gate voltage, Vgl is the voltage of the lens electrode placed directly above the emitters, I is the current in use, L is the distance between the gate electrode and the lens electrode, m is the mass of the electron, e is the electric charge and $e_0$ is the permittivity of a vacuum.

5. A method of manufacturing a field emission cold cathode device, having:

a field emission cold cathode element which comprises a plurality of emitters formed on a substrate and each in the shape of a sharply pointed projection, and a gate electrode provided with an opening section to let electrons emit from the respective apexes of said group of emitters and set in the vicinity above said group of emitters, wherein a positive voltage with respect to the emitters is applied to said gate electrode and thereby an electron beam is emitted from the group of emitters;

a lens electrode making the electron beam which is emitted from said group of emitters converge; and a target on which the electron beam made to converge by said lens electrode irradiates; which comprises steps of: forming the element so as to make the area S of a region occupied by the group of emitters equal to or less than $$St\cdot(Vt/Vg)\cdot\{\sin(q)/\sin(p)\}^2,$$

where, with respect to the emitters, Vg is the gate voltage, Vt is the target voltage, e is the electric charge, p is the angle made between the travelling direction of the outermost electron in the electron beam when the kinetic energy of an electron from the emitters is e·Vg and the line normal to the gate face, St is the area of the electron beam on the target, q is the angle made between the travelling direction of the outermost electron in the electron beam incident on the target and the line normal to the gate face and I is the current in use.

6. A method of manufacturing a field emission cold cathode device, having:

a field emission cold cathode element which comprises a plurality of emitters formed on a substrate and each in the shape of a sharply pointed projection, and a gate electrode provided with an opening section to let electrons emit from the respective apexes of said group of emitters and set in the vicinity above said group of emitters, wherein a positive voltage with respect to the emitters is applied to said gate electrode and thereby an electron beam is emitted from the group of emitters;

a lens electrode making the electron beam which is emitted from said group of emitters converge; and a target on which the electron beam made to converge by said lens electrode irradiates; which comprises steps of: forming the element so as to make the area S of a region occupied by the group of emitters equal to or more than $$9\cdot I\cdot L^2/\{4\cdot e_0(2\cdot e/m)^{1/2}\cdot(Vg^{1/2}+Vgl^{1/2})^3\},$$

where, with respect to the emitters, Vg is the gate voltage, Vgl is the voltage of the lens electrode placed directly above the emitters, I is the current in use, L is the distance between the gate electrode and the lens electrode, m is the mass of the electron, e is the electric charge and $e_0$ is the permittivity of a vacuum; and, at the same time, make the area S of the region occupied by the group of emitters equal to or less than $$St\cdot(Vt/Vg)\cdot\{\sin(q)/\sin(p)\}^2,$$

where, with respect to the emitters, Vg is the gate voltage, Vt is the target voltage, e is the electric charge, p is the angle made between the travelling direction of the outermost electron in the electron beam when the kinetic energy of an electron from the emitters is e·Vg and the line normal to the gate face, St is the area of the electron beam on the target, q is the angle made between the travelling direction of the outermost electron in the electron beam incident on the target and the line normal to the gate face and I is the current in use.

* * * * *